US012543831B2

(12) United States Patent
Chao et al.

(10) Patent No.: US 12,543,831 B2
(45) Date of Patent: Feb. 10, 2026

(54) FOLDABLE BOTTLE HOLDER

(71) Applicant: TUMI, INC., Edison, NJ (US)

(72) Inventors: Pablo Chao, New York City, NY (US); Peter Chang-Lin Wu, Great Neck, NY (US); Victor G. Sanz, Whitehouse Station, NJ (US)

(73) Assignee: TUMI, INC., Edison, NJ (US)

( * ) Notice: Subject to any disclaimer, the term of this patent is extended or adjusted under 35 U.S.C. 154(b) by 0 days.

(21) Appl. No.: 18/563,664

(22) PCT Filed: May 25, 2022

(86) PCT No.: PCT/US2022/030958

§ 371 (c)(1),
(2) Date: Nov. 22, 2023

(87) PCT Pub. No.: WO2022/251385

PCT Pub. Date: Dec. 1, 2022

(65) Prior Publication Data

US 2024/0237792 A1 Jul. 18, 2024

Related U.S. Application Data

(60) Provisional application No. 63/193,572, filed on May 26, 2021.

(51) Int. Cl.
*A45C 7/00* (2006.01)
*A45C 11/00* (2006.01)
(Continued)

(52) U.S. Cl.
CPC ..... *A45C 7/0095* (2013.01); *A45C 11/00* (2013.01); *A45C 13/103* (2013.01);
(Continued)

(58) Field of Classification Search
CPC ..... A45C 7/0095; A45C 11/00; A45C 13/103; A45C 13/1046; A45C 13/30;
(Continued)

(56) References Cited

U.S. PATENT DOCUMENTS 4,548,375 A * 10/1985 Moss ..... A47G 23/0225 224/675
D382,483 S * 8/1997 Flasch ..... D9/455
(Continued)

FOREIGN PATENT DOCUMENTS

JP 2010172380 A * 8/2010
JP 2021000008 A * 1/2021
KR 200382024 Y1 4/2005

OTHER PUBLICATIONS

International Search Report and Written Opinion for PCT/US2022/030958 dated Sep. 9, 2022.

*Primary Examiner* — Don M Anderson
*Assistant Examiner* — Justin Caudill
(74) *Attorney, Agent, or Firm* — Lando & Anastasi, LLP

(57) ABSTRACT

A foldable bottle holder (10, 100, 106, 110) includes a foldable wall (12), a sheet (14), and a closure (16). The foldable wall (12) includes a first portion (20) and a second portion (22) that are connected by a hinge (24). A first portion (32) of the sheet (14) is secured to the foldable wall (12), and a second portion (34) of the sheet (14) cooperates with the first portion (20) of the foldable wall (12) to define an opening (36) of the bottle holder (10) so that the sheet (14) forms a bottom wall (38) of the bottle holder (10) connected to the second portion (22) of the foldable wall (12) and so that the foldable wall (12) and the sheet (14) together form side walls (39) of the bottle holder (10) and the opening (36). The closure (16) selectively retains the first portion (20) and the second portion (22) of the foldable wall (12) in a minimized condition of the foldable bottle holder
(Continued)

(10) and in open state of the closure (16) allows for a user to carry a bottle (50) in the foldable holder (10).

17 Claims, 15 Drawing Sheets

(51) Int. Cl.
*A45C 13/10* (2006.01)
*A45C 13/30* (2006.01)

(52) U.S. Cl.
CPC ..... *A45C 13/1046* (2013.01); *A45C 13/30* (2013.01); *A45C 2007/0013* (2013.01); *A45C 2013/306* (2013.01)

(58) Field of Classification Search
CPC ..... A45C 2007/0013; A45C 2013/306; A45C 2007/0004; A45F 2200/0583; F16B 45/026
USPC ..... 190/102
See application file for complete search history.

(56) References Cited

U.S. PATENT DOCUMENTS 6,401,993 B1 * 6/2002 Andrino ..... A45F 5/00 D3/229
8,793,847 B2 * 8/2014 Chung ..... A44B 19/382 24/415
D818,324 S * 5/2018 Rhodes ..... D7/607
D885,871 S * 6/2020 Adelman ..... D8/356
D940,539 S * 1/2022 Youn ..... A44B 11/24 D8/356
11,297,927 B1 * 4/2022 Johnson ..... B65D 81/18
2001/0042665 A1 * 11/2001 Siwak ..... A45C 5/06 190/111
2003/0042091 A1 * 3/2003 Oh ..... A45C 5/06 190/102
2003/0188942 A1 * 10/2003 Scicluna ..... A45C 13/30 190/111
2008/0010787 A1 * 1/2008 Kinskey ..... A45F 5/02 24/298
2008/0222859 A1 * 9/2008 Chepurny ..... F16B 45/026 5/81.1 R
2008/0245096 A1 * 10/2008 Hanson ..... A45C 11/20 220/592.2
2012/0125966 A1 * 5/2012 Greenspon ..... A45C 11/20 190/115
2013/0098954 A1 * 4/2013 Inglis ..... A45C 1/02 224/148.4
2014/0131372 A1 * 5/2014 Hiner ..... B65D 23/104 220/739
2018/0008023 A1 * 1/2018 Morrow ..... A45C 7/0095
2022/0142277 A1 * 5/2022 Michaeloff ..... A41D 27/201
2022/0322797 A1 * 10/2022 Aquino ..... A45F 3/04
2023/0225471 A1 * 7/2023 Togbah ..... A45C 13/02 206/315.1

* cited by examiner

FOLDABLE BOTTLE HOLDER

CROSS-REFERENCE TO RELATED APPLICATIONS

This application is a U.S. National Phase Application under 35 U.S.C. § 371 of International Application No. PCT/US2022/030958, filed May 25, 2022, which claims priority to U.S. Provisional Application 63/193,572 filed on May 26, 2021, the entire contents of each of which is hereby incorporated by reference.

FIELD OF THE INVENTION

The present disclosure is related to an accessory for carrying articles, such as articles of luggage and other carrying articles, the accessory including a foldable, deployable holder for carrying containers, such as water bottles.

BACKGROUND

Backpacks and other carrying articles often include external water bottle support structures. However, these water bottle support structures can create an undesirable aesthetic appearance and/or an unneeded structure when not in use. In addition, these structures are typically only used externally to hold a water bottle or other container.

Documents that may be related to the present disclosure include:

U.S. Patent Application Publication No. 2003/0228072 discloses a collapsible bottle container. The bottle container includes a base having a fold axis. The bottle container also includes a bottle container and a carrying strap that are collapsed into the base when the base is folded into a closed configuration.

SUMMARY OF THE INVENTION

It is desirable to provide an improved accessory that can be used with a carrying article, such as a backpack. It is desirable to provide the accessory with a holder for a container that can be positioned and used both outside a main compartment of a carrying article or stored inside a carrying article without taking up much space. The accessory can be used with a carrying article that can include for example, backpacks, briefcases, tote bags, pocketbooks, purses, messenger bags, duffel bags, sports equipment bags, suitcases including soft-shell luggage and hard-shell luggage, and other bags.

In some embodiments, the accessory includes a foldable bottle pouch that is integrated with and part of a carrying article, such as a bag. In some embodiments, the accessory includes a first portion of a foldable wall that is connected to and/or part of a wall of the carrying article. In some embodiments, the accessory is a separate item from the carrying article that can be attached to the carrying article with a carabiner.

According to an aspect of the present disclosure, there is provided an improved foldable, deployable bottle holder as described in the accompanying claims. According to an aspect of the present disclosure, a foldable, deployable bottle holder is provided.

According to an aspect of the present disclosure, the foldable bottle holder comprises a foldable wall, a sheet, and a closure. The foldable wall has a first portion and a second portion that are connected by a hinge, the foldable wall including a perimeter of the first portion and the second portion. The sheet comprises a perimeter, a first portion of the perimeter of the sheet being secured to the foldable wall, and a second portion of the perimeter of the sheet cooperating with the first portion of the foldable wall to define an opening of the bottle holder so that the sheet forms a bottom wall of the bottle holder connected to the second portion of the foldable wall and so that the foldable wall and the sheet together form side walls of the bottle holder and the opening. The closure is attached to the first portion and the second portion of the foldable wall that in a closed state selectively retain the first portion and the second portion of the foldable wall in parallel relation in a minimized condition of the foldable bottle holder and in open state of the closure allows for the first portion and the second portion of the foldable wall to extend in opposite directions from the hinge and for the sheet to be exposed in an expanded state of the foldable bottle holder.

In some embodiments, the closure is a zipper closure attached along the perimeter of the first portion and the second portion.

In some embodiments, the zipper closure is nylon.

In some embodiments, the foldable bottle holder further comprises a second closure for securely retaining a bottle in the bottle holder.

In some embodiments, the second closure comprises a channel defined within the second portion of the perimeter of the sheet; a cord received in the channel; and a cord lock positioned on the cord.

In some embodiments, the first portion of the foldable wall and the second portion of the foldable wall are substantially planar.

In some embodiments, the first portion of the foldable wall, the second portion of the foldable wall, and the hinge are integrally formed.

In some embodiments, the first portion and the second portion of the foldable wall not including the integrally formed hinge are in a range of about 2 inches (about 5.08 centimeters) wide to about 5 inches (about 12.7 centimeters) wide and in a range of about 2 inches (5.08 centimeters) in length to about 8 inches (20.32 centimeters) in length.

In some embodiments, the foldable wall and the hinge are made of a ballistic nylon.

In some embodiments, the foldable bottle holder further comprises a clip secured to the first portion of the foldable wall.

In some embodiments, the clip is secured to the first portion of the foldable wall by a strap that is secured to and substantially flush with the first portion of the foldable wall.

In some embodiments, the sheet comprises a lightweight water-resistant material.

In some embodiments, the sheet comprises at least one vented opening to liquids and condensation from a bottle disposed in the bottle holder.

In some embodiments, the article comprises a body having an outer wall that is secured to the foldable wall of the foldable bottle holder.

In some embodiments, the outer wall is secured to the foldable wall by stitching.

In some embodiments, the outer wall is integrally formed with at least the first portion of the foldable wall.

In some embodiments, the article is any of a carrying article, a backpack, a duffel bag, or another article of luggage.

According to an aspect of the present disclosure, the foldable bottle holder comprises a foldable wall, a sheet, and a closure. The foldable wall has a first portion and a second portion that are connected by a hinge, the foldable wall including a perimeter of the first portion and the second portion. The sheet comprises a perimeter, a first portion of the perimeter of the sheet being secured to the foldable wall, and a second portion of the perimeter of the sheet cooperating with the first portion of the foldable wall to define an opening of the bottle holder so that the sheet forms a bottom wall of the bottle holder connected to the second portion of the foldable wall and so that the foldable wall and the sheet together form side walls of the bottle holder and the opening. The closure is attached to the first portion and the second portion of the foldable wall that in a closed state selectively retain the first portion and the second portion of the foldable wall in parallel relation in a minimized condition of the foldable bottle holder and in open state of the closure allows for the first portion and the second portion of the foldable wall to extend in opposite directions from the hinge and for the sheet to be exposed in an expanded state of the foldable bottle holder.

In some embodiments, the closure is a zipper closure attached along the perimeter of the first portion and the second portion.

In some embodiments, the zipper closure is nylon.

In some embodiments, the foldable bottle holder further includes a second closure for securely retaining the bottle in the bottle holder. The second closure comprises a channel defined within the second portion of the perimeter of the sheet; a cord received in the channel; and a cord lock positioned on the cord.

In some embodiments, the first portion of the foldable wall and the second portion of the foldable wall are substantially flat.

In some embodiments, the first portion of the foldable wall, the second portion of the foldable wall, and the hinge are integrally formed. In some embodiments, the first portion and the second portion of the foldable wall not including the integrally formed hinge are about 3.25 inches wide and about 3.75 inches in length.

In some embodiments, the foldable wall and the hinge are made of a ballistic nylon.

In some embodiments, the foldable bottle holder further comprises a carabiner clip secured to the first portion of the foldable wall.

In some embodiments, the carabiner clip is made of metal.

In some embodiments, the carabiner clip is secured to the first portion of the foldable wall by a strap that is secured to and substantially flush with the first portion of the foldable wall.

In some embodiments, the strap is made of a webbing material.

In some embodiments, the sheet comprises a lightweight water-resistant material.

In some embodiments, the sheet comprises at least one vented opening to liquids and condensation from a bottle disposed in the bottle holder.

It is appreciated that any of the features of any of the embodiments can be used with any of the aspects and embodiments and it is understood that they can so be combined in any manner.

BRIEF DESCRIPTION OF THE DRAWINGS

Various aspects of at least one embodiment are discussed below with reference to the accompanying figures. The figures are provided for the purposes of illustration and explanation and are not intended as a definition of the limits of the invention. In the figures.

LIST OF REFERENCE NUMERALS UTILIZED IN THE DRAWINGS

Figure 1:
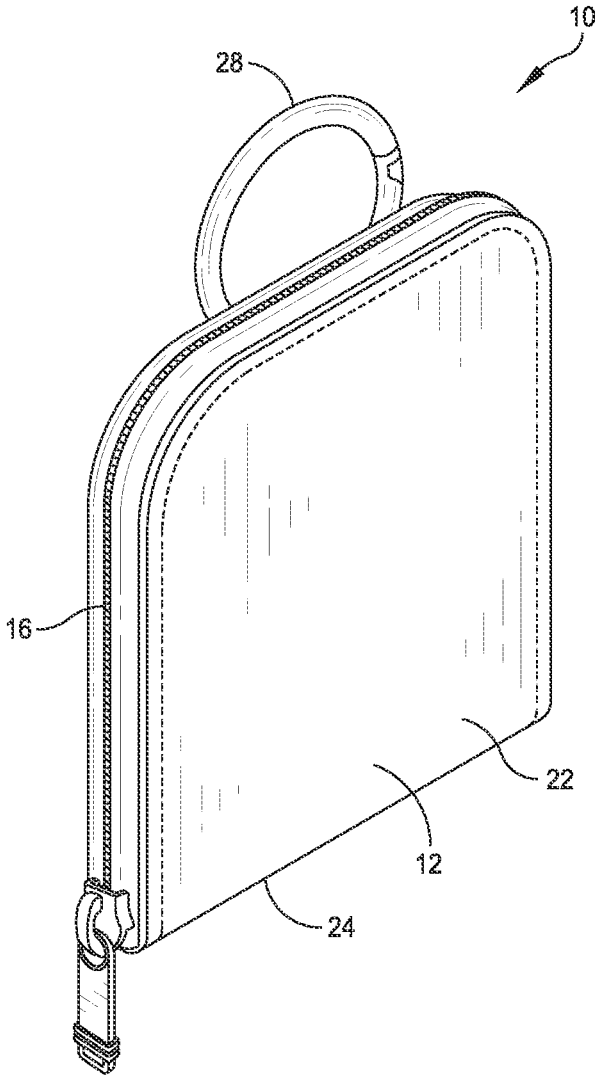
FIG. 1 is a perspective view of an embodiment of a foldable bottle holder in a closed condition.

With regard to reference numerals used, the following numbering is used throughout the description and drawings. Where technical features in the figures or detailed description are followed by these reference numerals, the reference numerals have been included for the sole purpose of increasing the intelligibility of the figures or detailed description. Accordingly, neither the reference numerals nor their absence is intended to have any limiting effect on the scope of any claim elements. In the figures, each identical or nearly identical component that is illustrated in various figures is represented by a like numeral. For purposes of clarity, not every component may be labeled in every figure.

Reference numeral 10 refers to a foldable bottle holder;

Reference numeral 12 refers to a foldable wall;

Reference numeral 14 refers to a sheet;

Reference numeral 16 refers to a closure;

Reference numeral 18 refers to a perimeter of the foldable wall;

Reference numeral 20 refers to a first portion of the foldable wall;

Reference numeral 22 refers to a second portion of the foldable wall;

Reference numeral 24 refers to a hinge;

Reference numeral 28 refers to a clip;

Reference numeral 30 refers to a strap;

Reference numeral 32 refers to a first portion of a perimeter of the sheet;

Reference numeral 34 refers to a second portion of the perimeter of the sheet;

Reference numeral 36 refers to an opening of the bottle holder;

Reference numeral 38 refers to a bottom wall of the bottle holder;

Reference numeral 39 refers to side walls of the bottle holder;
Reference numeral 40 refers to a vented opening;
Reference numeral 42 refers to a closure;
Reference numeral 44 refers to a cord;
Reference numeral 46 refers to a channel;
Reference numeral 48 refers to a cord lock;
Reference numeral 50 refers to a bottle;
Reference numeral 70 refers to a foldable bottle holder;
Reference numeral 72 refers to a cord lock;
Reference numeral 100 refers to a bottle holder;
Reference numeral 102 refers to a backpack;
Reference numeral 103 refers to a loop on the backpack 102;
Reference numeral 104 refers to a duffel bag;
Reference numeral 106 refers to a bottle holder;
Reference numeral 109 refers to a duffel bag;
Reference numeral 110 refers to a bottle holder;
Reference numeral 112 refers to a body of the duffel bag 104; and
Reference numeral 114 refers to a wall of the body 112 of the duffel bag 104.

DETAILED DESCRIPTION

Reference will now be made in detail to representative embodiments illustrated in the accompanying drawings. It should be understood that the following descriptions are not intended to limit the embodiments to one preferred embodiment. To the contrary, they are intended to cover alternatives, modifications, and equivalents as may be included within the spirit and scope of the described embodiments as disclosed. It is appreciated that any of the features of any of the embodiments can be used with any of the aspects and embodiments and it is understood that they can so be combined in any manner.

According to the present disclosure, a foldable bottle holder is configured to hold a container and is configured to be secured to a carrying article. The carrying article can be a variety of articles including for example, backpacks, briefcases, tote bags, pocketbooks, purses, messenger bags, duffel bags, sports equipment bags, suitcases including soft-shell luggage and hard-shell luggage, and other bags. In some embodiments, the carrying article is an article of luggage. When the user wants to carry a container, such as a water bottle, within the foldable bottle holder, the user can unfold the foldable bottle holder. When the user wants to carry the foldable bottle holder in a compact configuration, the user can collapse the foldable bottle holder to a folded configuration. The foldable bottle holder may be folded and unfolded while still secured to the carrying article.

Figure 2:
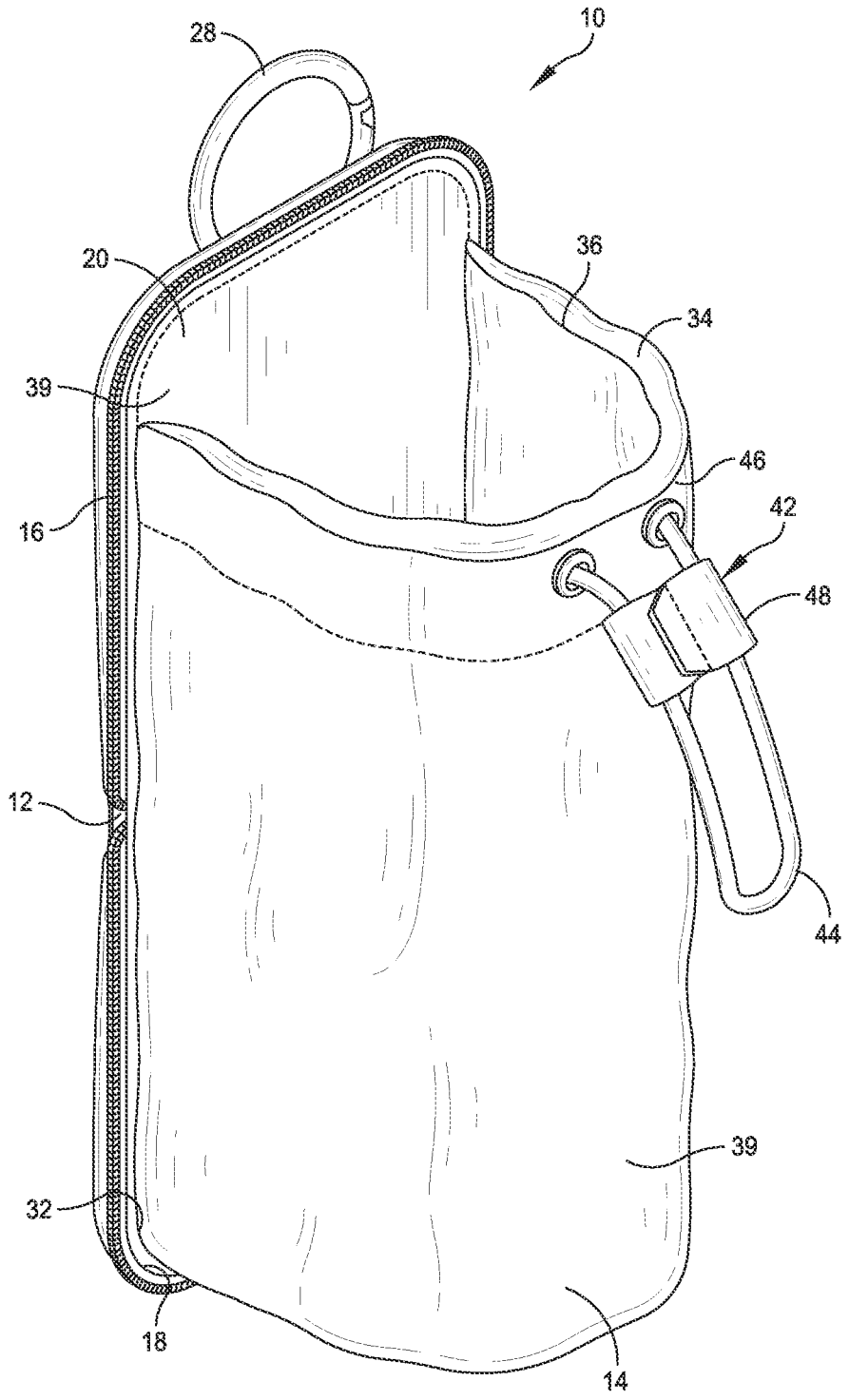
FIG. 2 is a perspective view of the bottle holder of FIG. 1 in an open condition.

FIGS. 1 and 2 show an exemplary embodiment of a foldable bottle holder (a foldable holder), generally indicated at 10, with a foldable wall of the foldable bottle holder 10 in a folded condition (FIG. 1) and an unfolded condition (FIG. 2), as described in further detail below. A user may selectively convert the foldable bottle holder 10 between the folded configuration of FIG. 1, in which the foldable bottle holder 10 is configured to be carried on or in a carrying article, and the unfolded configuration of FIG. 2, in which the foldable bottle holder 10 is configured to support a bottle. The foldable bottle holder 10 comprises a foldable wall 12 and a sheet 14 secured to the foldable wall 12 that together are capable of supporting a water bottle after the foldable wall 12 is unfolded from the folded condition (FIG. 1) to an unfolded condition (such as in FIG. 2). When a user does not wish to use the foldable bottle holder 10 to carry a bottle, the user may fold the foldable wall 12 to the folded condition (FIG. 1) and store the sheet 14 in a volume defined by a first portion 20 of the foldable wall 12 and a second portion 22 of the foldable wall. The user can then close a closure 16 on a perimeter 18 the foldable wall 12 to retain the sheet 14 within the volume defined by the first and second portions 20, 22 of the foldable wall 12.

The foldable wall 12 is configured to provide an outer housing of the foldable bottle holder 10 when the foldable wall 12 is in the folded condition (FIG. 1). Additionally, in some embodiments, the foldable wall 12 is configured to provide lateral stability to the foldable bottle holder 10 when the foldable wall 12 is in the unfolded condition (FIG. 2).

Figure 3:
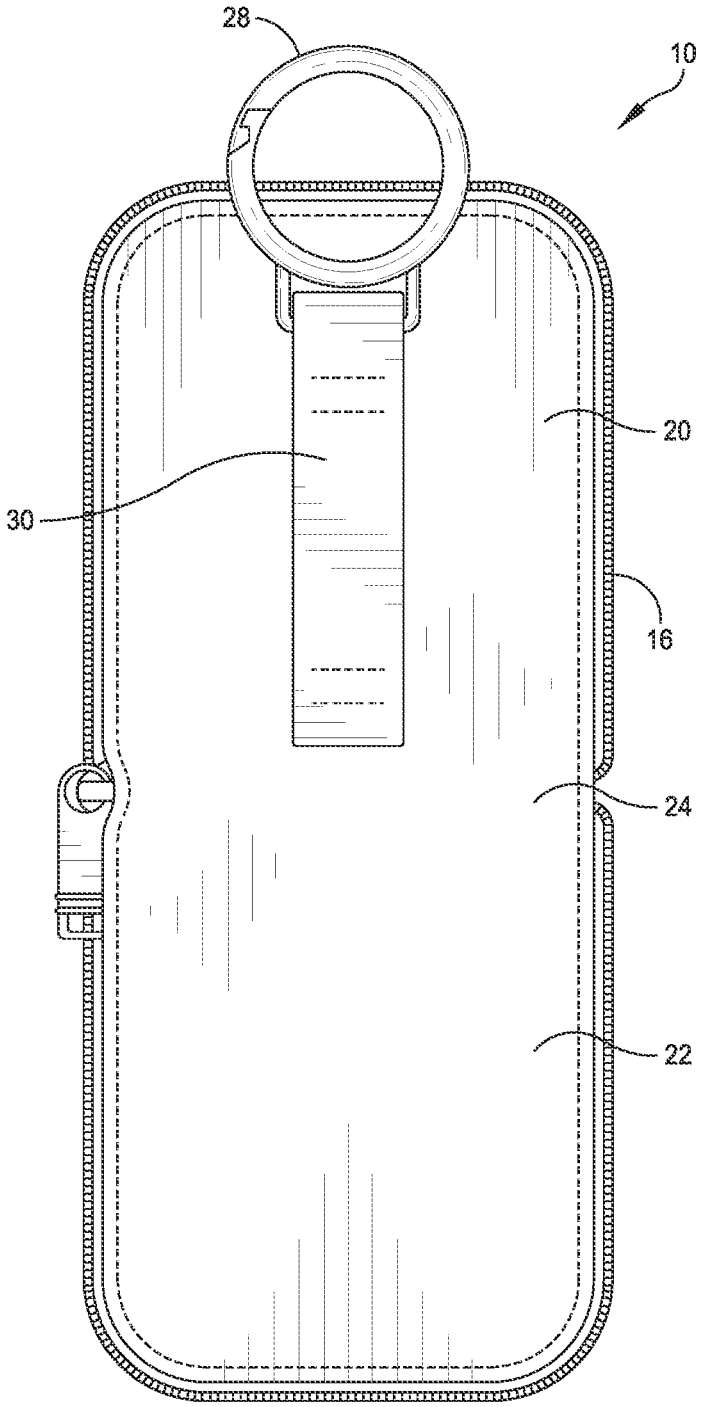
FIG. 3 is a rear view thereof.

FIG. 3 shows a rear view of the foldable holder 10 when the foldable wall 12 is in the unfolded condition. The first portion 20 and the second portion 22 of the foldable wall 12 are connected by a hinge 24. In some embodiments, the first portion 20 of the foldable wall 12 and the second portion 22 of the foldable wall 12 are substantially coplanar, as shown in the embodiment of FIG. 1.

When the user does not want to carry anything in the foldable bottle holder 10, the user may fold the foldable wall 12 about the hinge 24 so that the first portion 20 and the second portion 22 of the foldable wall 12 are in spaced apart substantially parallel relation, as shown in FIG. 1 and secure the first portion 20 to the second portion 22 by means of closure 16. When the user wants to carry something, such as a bottle, within the foldable bottle holder 10, the user may undo closure 16 and unfold the foldable wall 12 about the hinge 24 so that the first portion 20 and the second portion 22 extend in opposite directions from the hinge 24 and are substantially parallel, as shown in FIGS. 2 and 3. In FIGS. 2 and 3, the first portion 20 and the second portion 22 of the foldable wall 12 are substantially coplanar.

The foldable wall 12 may be made of a material comprising fabric. The foldable wall may include a reinforcing material. For example, the foldable wall may include a first piece of reinforcing material to maintain the first portion 20 in a substantially flat configuration. Similarly, the foldable wall may include a second piece of reinforcing material to maintain the second portion 22 in a substantially flat configuration. The pieces of reinforcing material may be covered in the fabric.

The hinge 24 may be made of a flexible material. In some embodiments, the hinge 24 may include living hinge. In some embodiments, the hinge 24 is a living hinge. In some embodiments, one or more biasing inserts may be secured to the first portion 20 and the second portion 22 at the hinge 24 to bias the foldable wall 12 to either the folded condition or the unfolded condition. For example, a biasing insert such as a leaf spring may be secured to the first portion 20 and the second portion 22 at the hinge 24 to bias the foldable wall 12 to the unfolded condition.

In some embodiments, the hinge 24 is made of the same material as the foldable wall 12. In some embodiments, the first portion 20, the second portion 22, and the hinge 24 are made of a ballistic nylon. In some embodiments, the hinge 24 is integrally formed with the first portion 20 of the foldable wall 12 and the second portion 22 of the foldable wall 12.

The foldable wall 12 is sized and configured to provide a support structure adjacent to a side of a container, such as a bottle, when the container is supported by the foldable wall 12 and sheet 14 of the foldable bottle holder 10. In the embodiment of FIG. 3, the first portion 20 and the second portion 22 of the foldable wall 12 (not including the integrally formed hinge 24) are about 3.25 inches wide and about 3.75 inches in length. In some embodiments, the integrally formed hinge 24, as shown in FIG. 3, is a substantially one-dimensional crease demarcating a transition between the first portion 20 and the second portion 22 of the foldable wall 12, and the hinge 24 does not contribute to the overall length of the foldable wall 12 when the foldable wall 12 is in the unfolded condition. In some embodiments, the integrally formed hinge 24 may have a length that is greater than zero.

The foldable wall 12 includes a perimeter 18. The perimeter 18 of the foldable wall 12 extends around the first portion 20 and the second portion 22 of the foldable wall. The closure 16 is attached to the first portion 20 and the second portion 22 of the foldable wall 12 at or about the perimeter 18 and along the perimeter 18 of the foldable wall 12.

The foldable wall 12 is attached to a portion of the sheet 14 at a first portion 32 of a perimeter of the sheet 14. This arrangement is configured to contain the sheet 14 within the foldable holder in the closed condition when the foldable bottle holder 10 is not being used to carry a bottle. When the closure 16 is in a closed state, the closure 16 retains the first portion 20 and the second portion 22 of the foldable wall in parallel relation in a minimized condition of the foldable bottle holder 10 (FIG. 1).

When the closure 16 is in an open state, the closure allows for the first portion 20 and the second portion 22 of the foldable wall 12 to extend in opposite directions from the hinge 24 and for the sheet 14 to be deployed and exposed in an expanded state of the foldable bottle holder 10 (FIG. 2).

In FIGS. 1-3, the closure 16 is a zipper closure attached to the first portion 20 and the second portion 22 of the foldable wall 12 along the perimeter 18 of the foldable wall 12. In some embodiments, the zipper closure is a nylon zipper.

In some embodiments, the closure 16 is a fastener, such as a hook and loop fastener, a magnetic fastener, or another fastener known and used by one of skill in the art. In some embodiments, the closure is a clasp.

In some embodiments, the foldable bottle holder 10 is formed separately from a carrying article, and a user may selectively secure the foldable bottle holder 10 to a carrying article or selectively remove the foldable bottle holder 10 from the carrying article. A user may secure the foldable bottle holder 10 to a carrying article, such as an article of luggage, when the foldable bottle holder 10 is being used to carry a bottle as well as when the foldable bottle holder 10 is not being used to carry a bottle. In some embodiments, the foldable bottle holder 10 includes a clip 28 that is secured to the first portion 20 of the foldable wall 12 by a strap 30.

The clip 28 is configured to support the weight of the foldable bottle holder 10 and the contents of the foldable bottle holder 10, such as a full water bottle, when the foldable bottle holder 10 is secured to a carrying article.

The clip 28 may be made of various materials. In some embodiments, the clip is made of metal and or plastic. In some embodiments, the clip 28 is a carabiner clip, as shown in the embodiment of FIG. 1. In some embodiments, the carabiner clip is a metal carabiner clip.

The clip 28 is secured to the first portion of the foldable wall by the strap 30 that is secured to and substantially flush with the first portion 20 of the foldable wall 12.

In some embodiments, the strap 30 is a fabric strap. In some embodiments, the strap 30 is made of a webbing material.

Figure 4:
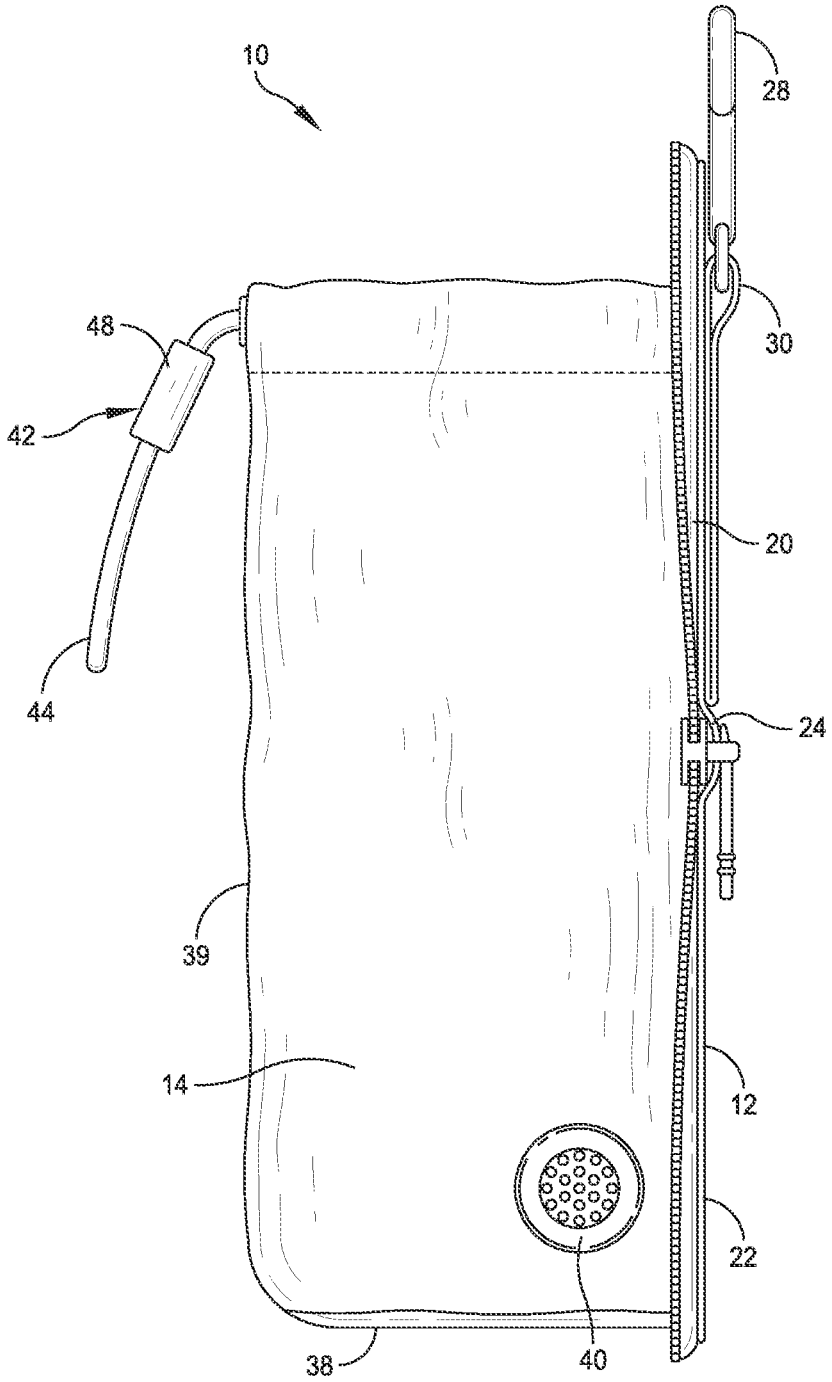
FIG. 4 is a side view thereof.
Figure 5:
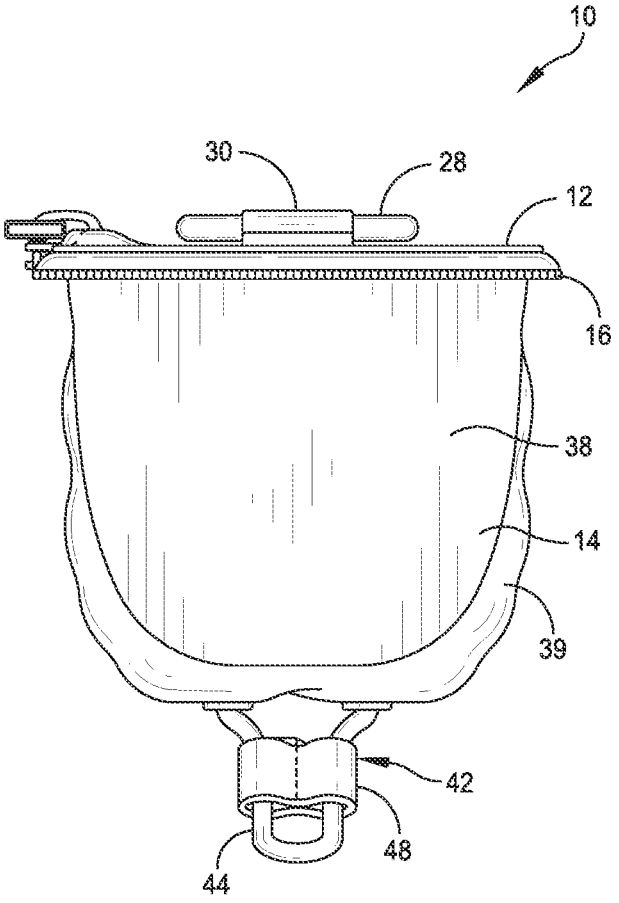
FIG. 5 is a bottom view thereof.

As shown in the side view of FIG. 5, the clip 28 is oriented on the foldable wall 12 of the foldable bottle holder 10 so the clip 28 has a narrow dimension that is perpendicular to an external face of the first portion 20 of the foldable wall 12 so the clip has a compact, low profile in the side view as shown in FIG. 4. The clip 28 is also oriented on the foldable wall 12 of the foldable bottle holder 10 so that the clip 28 extends beyond the periphery of the first portion 20 of the foldable wall 12.

The clip 28 may be selectively secured to a loop, a strap, or another feature on the article of luggage. For example, the clip 28 may be secured to loop affixed to a shoulder strap of the article of luggage or a loop on the side of the article of luggage.

The sheet 14 has a perimeter. A first portion 32 of the perimeter of the sheet 14 is secured to the foldable wall 12, and a second portion 34 of the sheet cooperates with the first portion 20 of the foldable wall to define an opening 36 of the bottle holder 10 so that the sheet 14 forms a bottom wall 38 of the bottle holder 10 connected to the second portion 22 of the foldable wall 10 and so that the foldable wall 12 and the sheet 14 together form side walls 39 of the bottle holder 10 and the opening 36.

The flexible sheet 14 of the foldable bottle holder 10 is sized and configured to accommodate water bottles of various sizes within the foldable bottle holder 10 when the foldable wall is in the expanded condition.

In some embodiments, the sheet 14 comprises a lightweight water-resistant material.

In some embodiments, the sheet 14 comprises at least one vented opening 40 to allow passage of liquids and condensation from a bottle disposed in the bottle holder.

To securely retain a bottle within the foldable bottle holder 10, a closure 42 is located at the upper end of the sheet 14. The closure, generally indicated at 42, may include a fastener or an elastic member.

In the embodiment of FIG. 1, the closure 42 includes a cord 44 positioned in a channel 46. The channel 46 is defined within the second portion 34 of the perimeter of the sheet 14. The cord 44 is received in the channel 46. To tighten the cord 44 about an upper end of a bottle that is positioned within the bottle holder 10, the user pulls on the cord 44. To maintain a tension in the cord 44, the user adjusts a cord lock 48 that is located along the length of the cord 44. The cord lock 48 may include a spring biased lock, a clamp, a magnetic lock, or another lock. The closure 42, cord 44, and cord lock 48 are configured to securely retain the bottle in the bottle holder 10.

FIG. 5 shows a bottom view of the bottle holder 10 when the foldable wall 12 is rotated to the open configuration and the flexible sheet 14 is pulled away from the foldable wall 12 to receive a bottle between the foldable wall 12 and the flexible sheet 14. The flexible sheet 14 forms the base 38 of the bottle holder 10 and a portion of the side wall of the bottle holder 10 when the bottle holder is in the open configuration. The flexible sheet 14 is configured to accommodate bottles of varying diameters, and the resulting base 38 of the bottle holder 10 will be as wide as it needs to be to accommodate the base of the bottle within the bottle holder 10.

Figure 6:
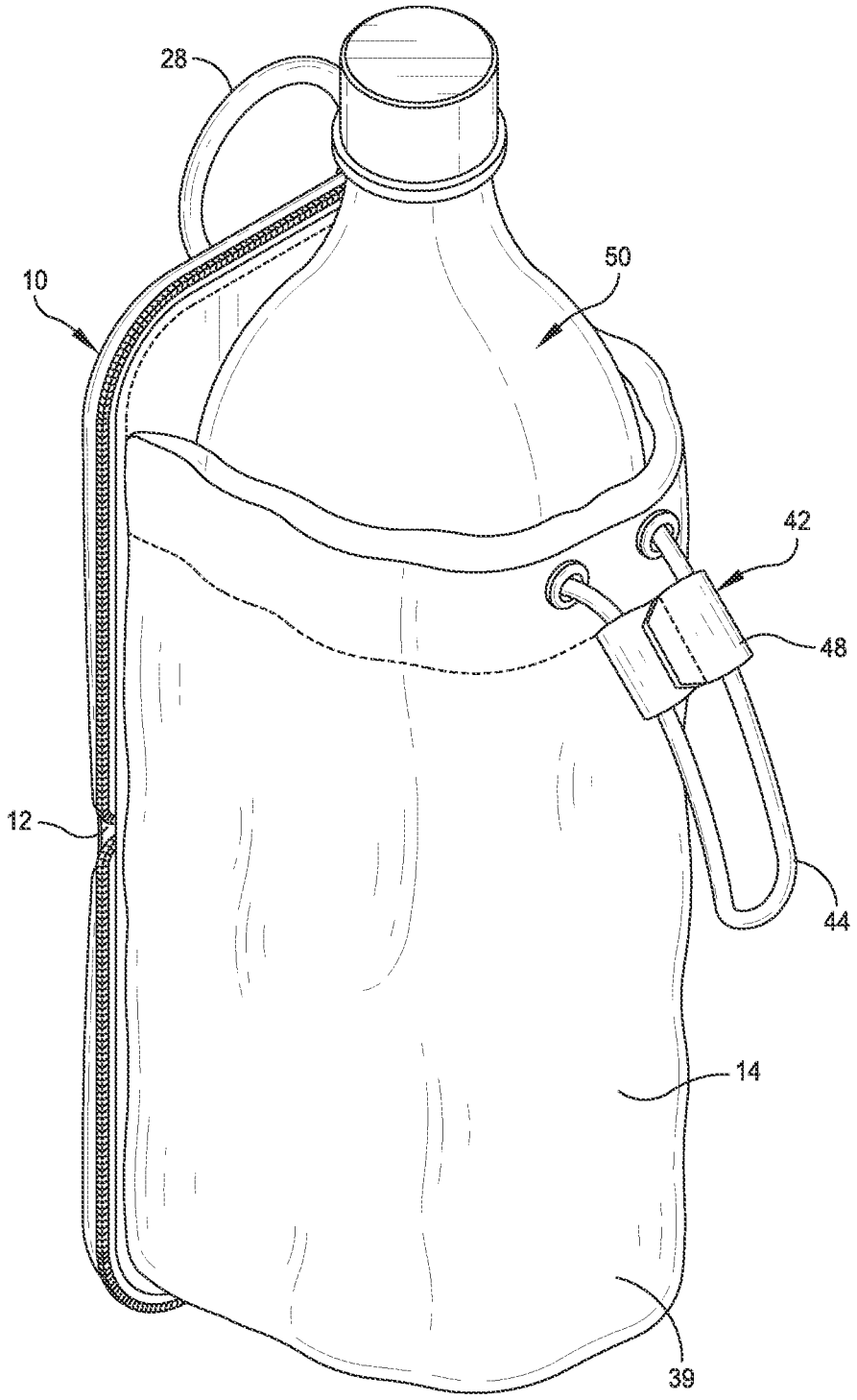
FIG. 6 is a perspective view thereof with a bottle within the foldable bottle holder.

FIG. 6 shows a perspective view of the bottle holder 10 when a bottle 50 is a received in the bottle holder 10.

FIGS. 7A-7E show various views of an embodiment of a foldable bottle holder 70 according to the present disclosure. The embodiment of the foldable bottle holder 70 of FIGS. 7A-7E includes similar features to the foldable bottle holder 10 of FIG. 1, with like feature numbers indicating like features. The foldable bottle holder 70 includes a cord lock 72 instead of cord lock 48.

Figure 7A:
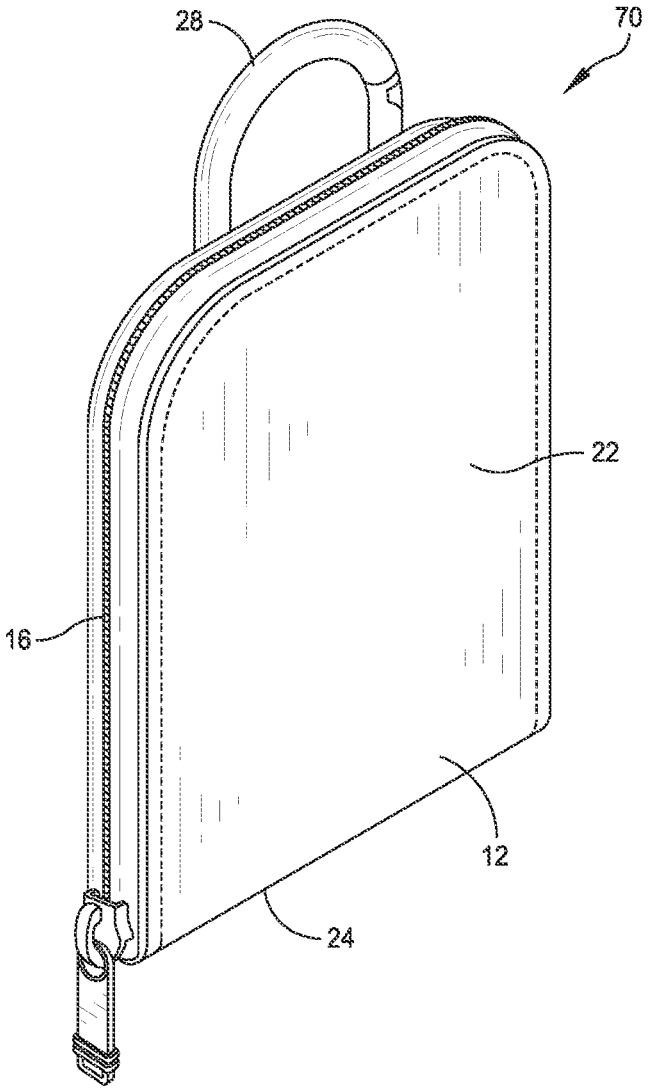
FIG. 7A is a perspective view of an embodiment of a bottle holder according to the present disclosure.
Figure 7B:
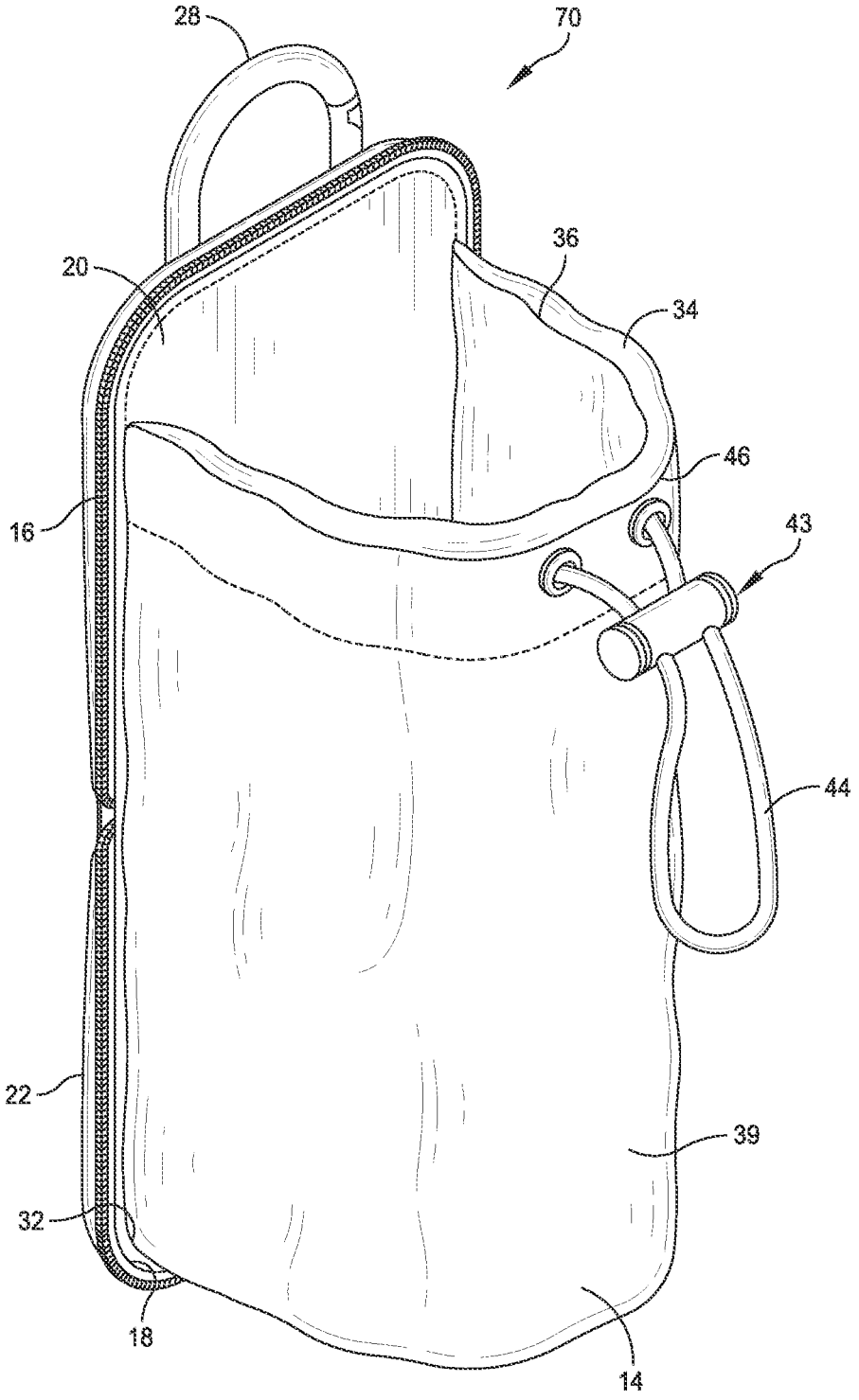
FIG. 7B is a perspective view of the foldable bottle holder of FIG. 7A in an open condition.
Figure 7C:
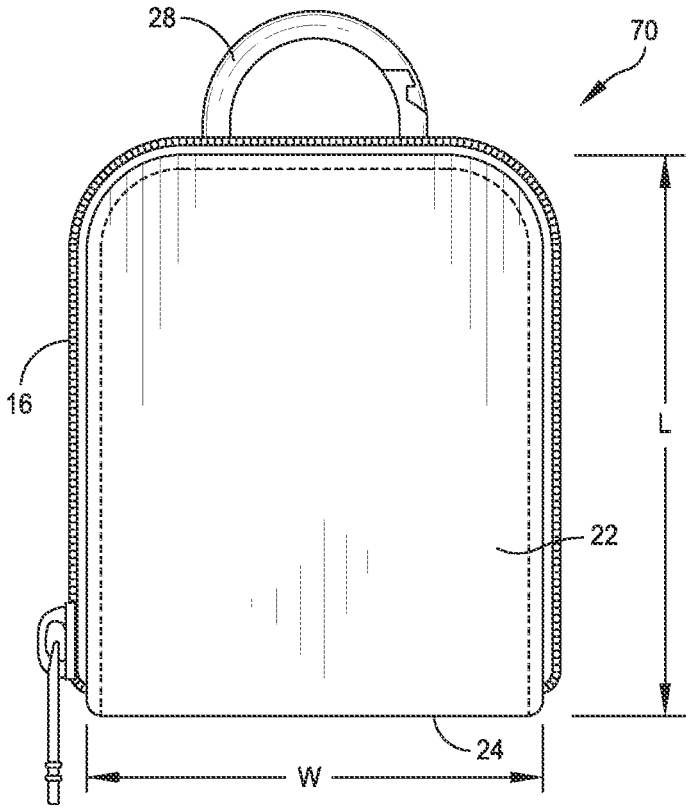
FIG. 7C is a front view of the foldable bottle holder of FIG. 7A.
Figure 7D:
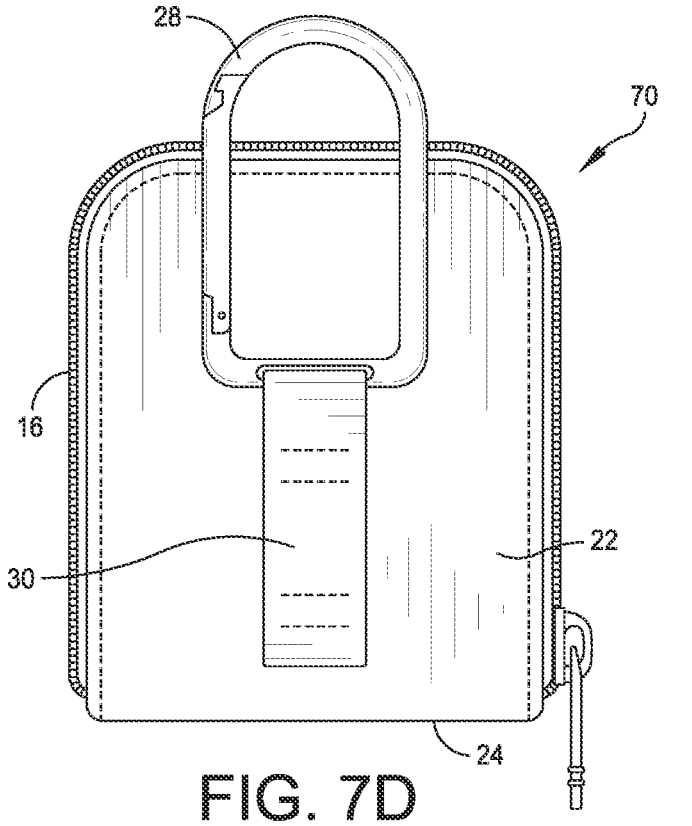
FIG. 7D is a rear view of the foldable bottle holder of FIG. 7A.
Figure 7E:
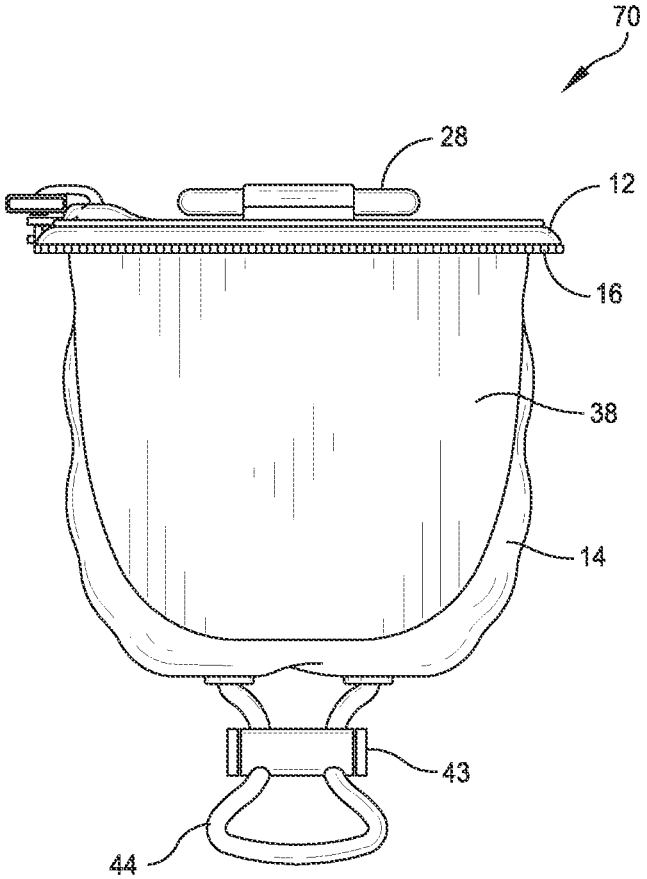
FIG. 7E is a bottom view of the foldable bottle holder of FIG. 7A.

In FIG. 7C, the foldable bottle holders of the present disclosure may have various dimensions. The second portion 22 of the foldable wall 12 is shown as having a width W and a length L. In some embodiments, the width W is about 3.25 inches (8.255 centimeters), and the length L is 3.75 inches (9.525 centimeters).

In some embodiments, the first portion 20 and the second portion 22 of the foldable wall 12 not including the integrally formed hinge 24 are each in a range of about 2 inches (about 5.08 centimeters) wide to about 5 inches (about 12.7 centimeters) wide and are each in a range of about 2 inches (5.08 centimeters) in length to about 8 inches (20.32 centimeters) in length. In some embodiments, the first portion 20 and the second portion 22 of the foldable wall 12 not including the integrally formed hinge 24 are each in a range of about 3 inches (about 7.62 centimeters) wide to about 4 inches (about 10.16 centimeters) wide and are each in a range of about 3 inches (7.62 centimeters) in length to about 4 inches (10.16 centimeters) in length.

Figure 8:
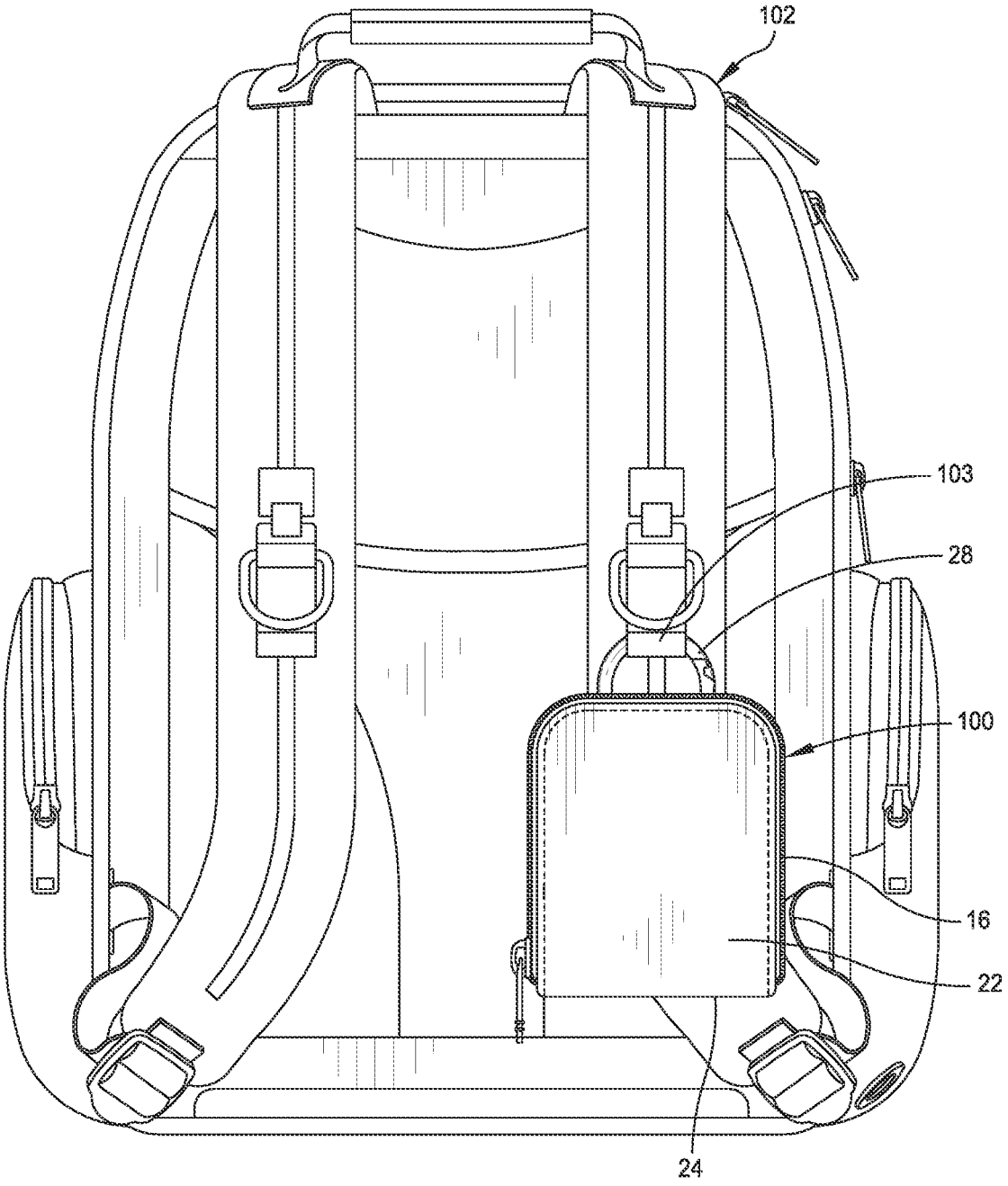
FIG. 8 shows an embodiment of a bottle holder secured to a backpack.

FIG. 8 shows an embodiment of a bottle holder 100 secured to a backpack 102. The bottle holder 100 may be the same as bottle holder 10, with like feature numbers indicating like features. A user may secure the foldable bottle holder 100 to the backpack 102 as shown in FIG. 8 by securing the clip 28 to a loop 103 on the backpack 102. The loop 103 in FIG. 8 is secured to one of a pair of shoulder straps of the backpack 102.

Figure 9:
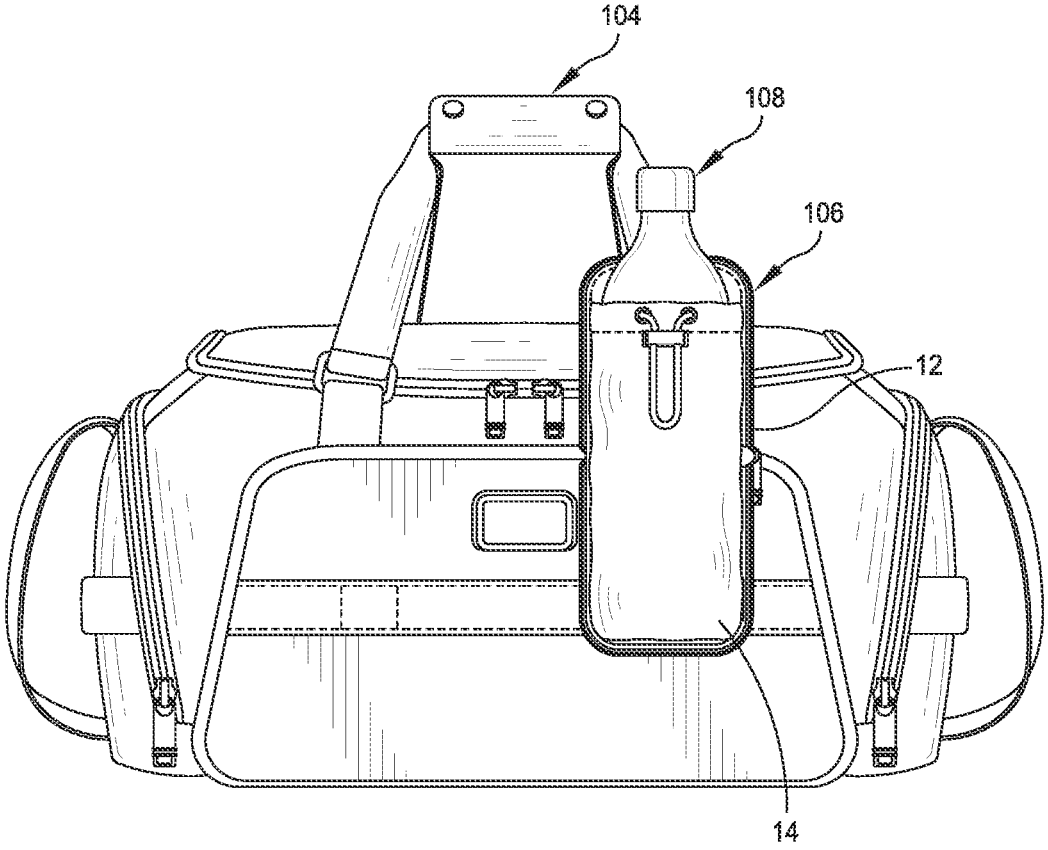
FIG. 9 shows an embodiment of a bottle holder secured to a duffel bag.

FIG. 9 shows an embodiment of a bottle holder 106 secured to a duffel bag 104. The bottle holder 104 may be the same as bottle holder 10. A bottle 108 is supported within the bottle holder 106. A user may secure the foldable bottle holder 104 to the duffel bag 104 by securing the clip 28 to a handle strap of the duffel bag 104.

In some embodiments, the foldable bottle holder of the present disclosure may be secured directly to a carrying article. For example, the foldable wall of the foldable bottle holder may be secured directly to an outer wall of a body of an article of luggage. In some embodiments, the foldable wall may be secured to the outer wall by a fastening means such as stitching or an adhesive or another fastening means. In some embodiments, the foldable wall may be integrally formed with the outer wall of the body of the article of luggage. In some embodiments, at least the first portion of the foldable wall is secured directly to the outer wall of the body of the article of luggage.

In some embodiments, the foldable bottle holder of the present disclosure may be integrated and part of a carrying article, such as a bag. For example, a first or second portion of a foldable wall of the bottle holder may be connected to and/or part of a wall of a carrying article.

Figure 10:
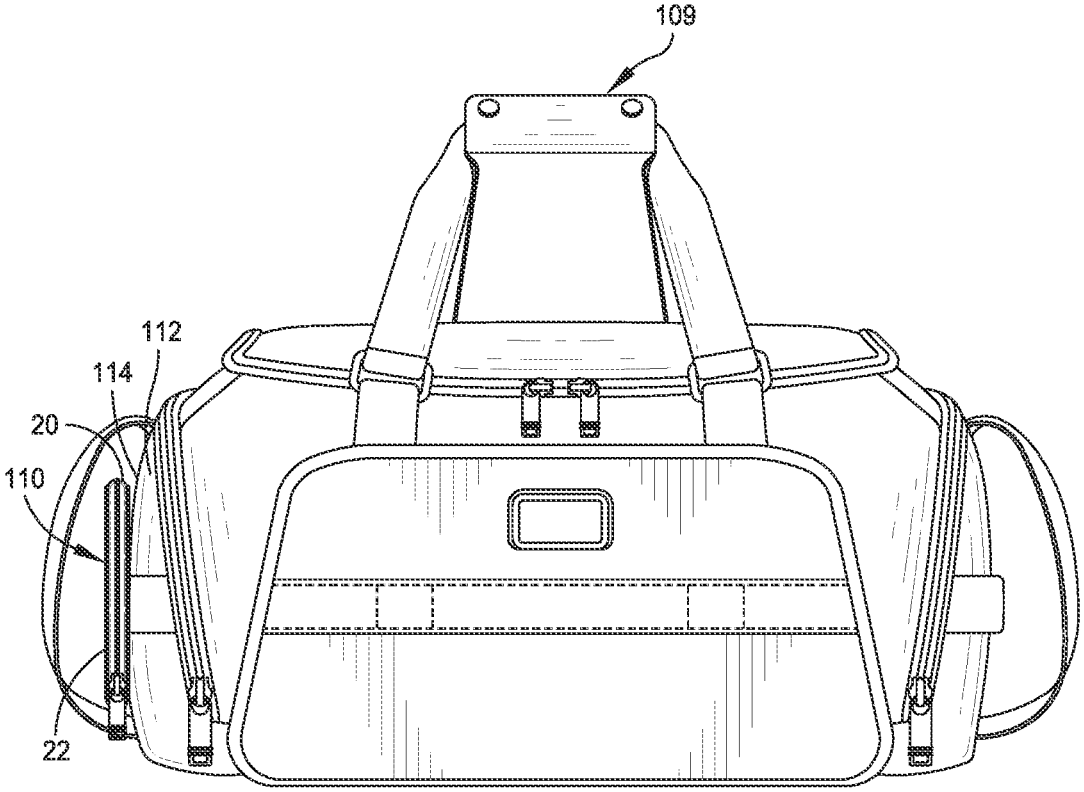
FIG. 10 shows an embodiment of a bottle holder integrated in a carrying article, the bottle holder being in a closed condition.
Figure 11:
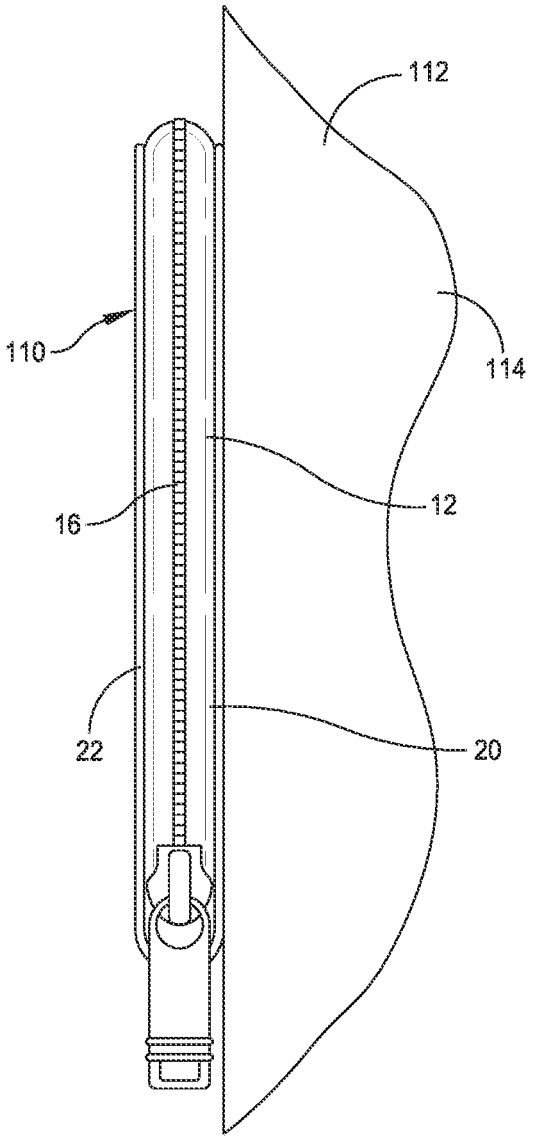
FIG. 11 shows an enlarged view of the bottle holder integrated in the carrying article of FIG. 10

FIG. 10 shows an embodiment of a bottle holder 110 secured to a body of a carrying article in the form of a duffel bag 109. The bottle holder 110 is in a closed condition in FIG. 10. FIG. 11 is an enlarged view of the bottle holder 110 of FIG. 10. The foldable bottle holder may be constructed in a similar manner as the foldable bottle holder 10 of FIG. 1, with like numbers indicating like features. Unlike the embodiment of FIG. 1, the first portion 20 of the foldable wall 12 of the foldable bottle holder 110 of FIG. 10 is integrated into a wall 114 of a body 112 of the duffel bag 109. Unlike the embodiment of FIG. 1, the bottle holder 110 does not include a clip 28 and a strap 30 secured to the first portion 20 of the foldable wall 12. In some embodiments, the first portion 20 of the foldable wall 12 is secured to the wall 114 by a fastening means. In some embodiments, the fastening means may be stitching, an adhesive, or another fastening means In some embodiments, the foldable wall 12 includes a material that is the same as a material of the wall 114 of the body 112 of the duffel bag 109. In some embodiments, the foldable wall 12 includes a material that is different from a material of the wall 114 of the body 112 of the duffel bag 109.

Figure 12:
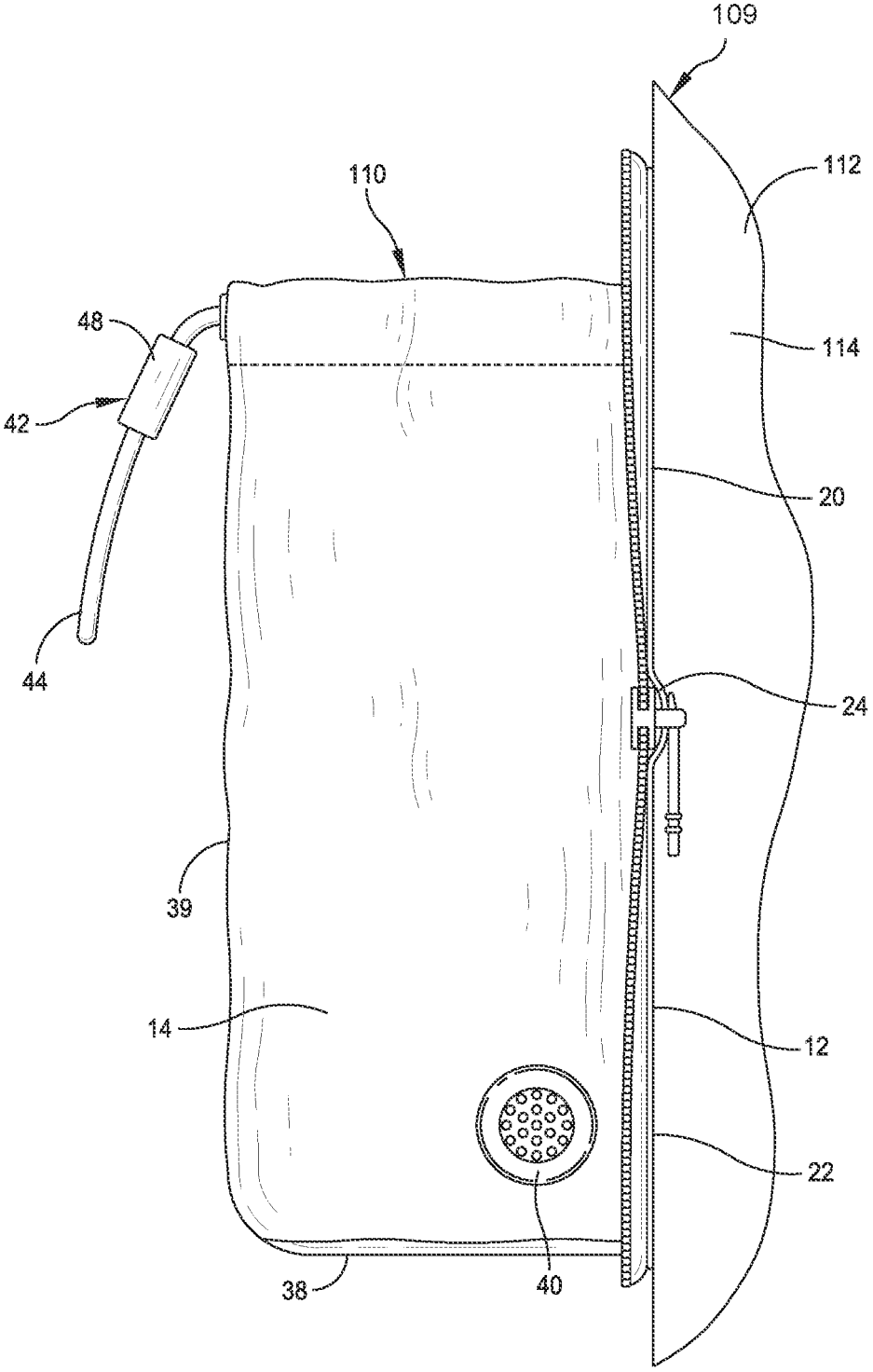
FIG. 12 shows the foldable bottle holder of FIG. 10 in an open condition.

FIG. 12 shows the foldable bottle holder 110 of FIG. 10 in an open condition.

As can be seen from the above description, foldable bottle holders of the present disclosure are capable of being carried or stored in a flat, compact configuration, and then expanded to a configuration in which they can carry a bottle. The foldable water bottle of the present disclosure includes a foldable wall that improves lateral stability of the bottle holder, such as for example, when the bottle holder is clipped to a carrying article, such as a backpack or another bag. The foldable wall improves the stability of the bottle holder with respect to the carrying article to which the bottle holder is clipped by increasing the bottle holder's resistance to rolling about a long axis, such as a vertical axis, of the bottle in the bottle holder when the foldable wall is in direct engagement with an outer surface of the carrying article. The foldable bottle holder includes a sheet that is flexible so that the portion of the side wall of the bottle holder that is formed by the sheet takes up minimal space and substantially conforms to the outer shape of the portion of the bottle over which the sheet extends. One advantage of the bottle holder is that, because the flexible sheet forms the base and the portion of the side wall of the holder when the holder is in the open configuration to hold a bottle, the base of the bottle holder need not be a fixed size. The base of the bottle holder will conform to the shape of the base of the bottle being held in the bottle holder. Additional advantages of the bottle holder include that the clip provides for easy attachment to a carrying article; the sheet is made of a water resistant material which retains liquids/condensation; and the vented opening allows for any liquids/condensation to be vented out of the bottle holder. Still additional advantages of the foldable bottle holder is that it is compact and takes up little space when in the folded configuration, and that the foldable wall provides rigidity to the holder.

As can be seen from the above description, the present disclosure provides a holder that allows a user to selectively support a container in an upright position either inside a compartment of a carrying article or outside the compartment of a carrying article. This allows a user to allocate the volume of the compartment as desired. When the user has sufficient volume available in the compartment to position a container, such as a bottle, in the compartment, the user can unfold the holder and move the holder into the compartment so that the bottle does not obscure any portion of the outside of the backpack. Some of the advantages of housing the container are that it improves the aesthetic appearance of the carrying article. When the user cannot fit the container in the compartment of the backpack along with other objects the user would like to carry in the compartment of backpack, or when the user would like to position the container outside of the compartment for any other reason such as ease of accessibility to the container, the user can move the holder to a position located outside of the compartment. Some of the advantages of housing the container outside of the carrying article are the ease of accessibility to the container and that the container is secured to carrying article.

While the disclosed subject matter is described herein in terms of certain exemplary embodiments, those skilled in the art will recognize that various modifications and improvements can be made to the disclosed subject matter without departing from the scope thereof. As such, the particular features claimed below and disclosed above can be combined with each other in other manners within the scope of the disclosed subject matter such that the disclosed subject matter should be recognized as also specifically directed to other embodiments having any other possible permutations and combinations. It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

What is claimed:

1. A foldable bottle holder formed separately from an article that may be selectively secured to or removed from the article, comprising:

a foldable wall having a first portion and a second portion that are connected by a hinge, the foldable wall including a perimeter of the first portion and the second portion;

a sheet comprising a perimeter, a first portion of the perimeter of the sheet being secured to the foldable wall, and a second portion of the perimeter of the sheet cooperating with the first portion of the foldable wall to define an opening of the bottle holder so that the sheet forms a bottom wall of the bottle holder connected to the second portion of the foldable wall and so that the foldable wall and the sheet together form side walls of the foldable bottle holder and the opening;

a closure attached to the first portion and the second portion of the foldable wall that in a closed state selectively retain the first portion and the second portion of the foldable wall in parallel relation in a minimized condition of the foldable bottle holder and in open state of the closure allows for the first portion and the second portion of the foldable wall to extend in opposite directions from the hinge and for the sheet to be exposed in an expanded state of the foldable bottle holder the foldable bottle holder configured to be selectively secured to or removed from the article;

further comprising a clip secured to the foldable wall by a strap that is secured to and substantially flush with the foldable wall; and wherein the clip is a carabiner clip that includes an elongated slot disposed in a bottom side of the carabiner clip, and wherein the strap is disposed through the elongated slot of the carabiner clip so that clip is secured to the foldable wall by the strap.

2. The foldable bottle holder of claim 1, wherein the closure is a zipper closure attached along the perimeter of the first portion and the second portion.

3. The foldable bottle holder of claim 2, wherein the zipper closure is nylon.

4. The foldable bottle holder of claim 1, further comprising a second closure for securely retaining a bottle in the bottle holder.

5. The foldable bottle holder of claim 4, the second closure comprising:

a channel defined within the second portion of the perimeter of the sheet;

a cord received in the channel; and a cord lock positioned on the cord.

6. The foldable bottle holder of claim 1, wherein the first portion of the foldable wall and the second portion of the foldable wall are substantially planar.

7. The foldable bottle holder of claim 1, wherein the first portion of the foldable wall, the second portion of the foldable wall, and the hinge are integrally formed.

8. The foldable bottle holder of claim 1, wherein the first portion and the second portion of the foldable wall not including the integrally formed hinge are in a range of about 2 inches (about 5.08 centimeters) wide to about 5 inches (about 12.7 centimeters) wide and in a range of about 2 inches (5.08 centimeters) in length to about 8 inches (20.32 centimeters) in length.

9. The foldable bottle holder of claim 1, wherein the foldable wall and the hinge are made of a ballistic nylon.

10. The foldable bottle holder of claim 1, wherein the clip is secured to the first portion of the foldable wall.

11. The foldable bottle holder of claim 10, wherein the strap is secured to the first portion of the foldable wall.

12. The foldable bottle holder of claim 11, wherein the clip is configured to support a weight of the foldable bottle holder and a full bottle held by the foldable bottle holder.

13. The foldable bottle holder of claim 11, wherein the clip is oriented on the foldable bottle holder so that a portion of the clip extends beyond the periphery of the first portion of the foldable wall.

14. The foldable bottle holder of claim 1, wherein the sheet comprises a lightweight water-resistant material.

15. The foldable bottle holder of claim 1, wherein the sheet comprises at least one vented opening to liquids and condensation from a bottle disposed in the bottle holder.

16. The article in combination with the foldable bottle holder of claim 1, the article comprising a body any of a loop, a strap, a handle, or another feature so that the clip can be selectively secured to the article.

17. The article of claim 16, wherein the article is any of a carrying article, a backpack, a duffel bag, or an article of luggage.

* * * * *